US009966699B1

(12) United States Patent
Liu et al.

(10) Patent No.: US 9,966,699 B1
(45) Date of Patent: May 8, 2018

(54) PRESS TOOL AND ELECTRONIC PRODUCT DETECTING APPARATUS

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Shaoning Liu, Beijing (CN); Guofeng Hu, Beijing (CN); Guoqiang Liu, Beijing (CN); Weidong Lin, Beijing (CN); Xiaowen Xu, Beijing (CN); Yunxiang Jiao, Beijing (CN); Mingda Zhang, Beijing (CN); Yang Liu, Beijing (CN); Feng Wang, Beijing (CN); Weihua Cao, Beijing (CN); Liangliang Hu, Beijing (CN); Yantao Li, Beijing (CN); Dahai Liu, Beijing (CN); Jian Ma, Beijing (CN); Shijie Wang, Beijing (CN); Xiaobo Wang, Beijing (CN); Zhuangzhuang Wu, Beijing (CN); Zhenguo Xing, Beijing (CN); Yang Yu, Beijing (CN); Xing Zhang, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days. days.

(21) Appl. No.: 15/679,120

(22) Filed: Aug. 16, 2017

(30) Foreign Application Priority Data

Nov. 9, 2016 (CN) ..... 2016 1 0987328

(51) Int. Cl.
*H01R 13/64* (2006.01)
*H01R 13/631* (2006.01)
(Continued)

(52) U.S. Cl.
CPC ..... *H01R 13/6315* (2013.01); *H01F 7/02* (2013.01); *H01R 13/62933* (2013.01); *H01R 2201/20* (2013.01)

(58) Field of Classification Search
CPC ..... H01R 13/6315; H01R 13/62933; H01R 2201/20; H01F 7/02
(Continued)

(56) References Cited

U.S. PATENT DOCUMENTS

2007/0228736 A1* 10/2007 Smushkovich ..... F03B 13/1845 290/42
2011/0309552 A1* 12/2011 Amirouche ..... A61M 5/14224 264/331.11
(Continued)

FOREIGN PATENT DOCUMENTS

CN 203707547 U 7/2014

*Primary Examiner* — Jean F Duverne
(74) *Attorney, Agent, or Firm* — Kinney & Lange, P.A.

(57) ABSTRACT

Embodiments of the present invention provide a press tool and an electronic product detecting apparatus including the press tool. The press tool includes: a connector soft-contact member including: a first base plate; a floating plate mounted to the first base plate; and a buffer member mounted between the first base plate and the floating plate and configured such that when receiving a pressing force, the buffer member generates a repulsive force, so that the floating plate is floatable; and a press member connected with the connector soft-contact member such that they are openable and closable relative to each other. The press member includes a second base plate and a connector bearing piece which is mounted to the second base plate and which is positioned just opposite to the floating plate when
(Continued)

the connector soft-contact member and the press member are closed.

20 Claims, 7 Drawing Sheets

(51) Int. Cl.
*H01R 13/629* (2006.01)
*H01F 7/02* (2006.01)

(58) Field of Classification Search
USPC ..... 439/247
See application file for complete search history.

(56) References Cited

U.S. PATENT DOCUMENTS

2012/0235036 A1* 9/2012 Hatakeyama ..... G01N 23/2251 250/310
2017/0233798 A1* 8/2017 Neely ..... C12Q 1/6825 435/5
2017/0296173 A1* 10/2017 Shelton, IV ..... A61B 17/068

* cited by examiner

PRESS TOOL AND ELECTRONIC PRODUCT DETECTING APPARATUS

CROSS-REFERENCE TO RELATED APPLICATION

This application claims priority from and the benefit of Chinese Patent Application No. 201610987328.6, filed on Nov. 9, 2016, in the State Intellectual Property Office of China, the whole disclosure of which is incorporated herein by reference.

BACKGROUND

1. Technical Field

Embodiments of the present invention relate to a press tool and an electronic product detecting apparatus.

2. Description of the Related Art

In a manufacturing process of an electronic product, property of the electronic product needs to be detected. During the detection, a connector (hereinafter referred to as a "product connector") of the electronic product and a connector (hereinafter referred to as an "apparatus connector") of an electronic product detecting apparatus are brought into a plug-in connection.

As shown in FIGS. 1 and 2, the apparatus connector 2 is disposed on a carrier platform 4. When the product connector 1 and the apparatus connector 2 are brought into the plug-in connection, a pull assisting sheet 3 is disposed between them. After the detection, the pull assisting sheet 3 is lifted, so that the product connector 1 is pulled from the apparatus connector 2.

As shown in FIG. 3, a press tool is introduced. The press tool comprises the carrier platform 4, and a press plate 5 which is hinged to the carrier platform 4 and on which the apparatus connector 2 is disposed. During detection, the product connector 1 is placed on the carrier platform 4, and then the press plate 5 is closed to the carrier platform 4, so that the product connector 1 is brought into contact with the apparatus connector 2 without plug-in connection between them.

SUMMARY

Embodiments of the present invention provide a press tool comprising: a connector soft-contact member comprising: a first base plate; a floating plate mounted to the first base plate; and a buffer member mounted between the first base plate and the floating plate and configured such that, when receiving a pressing force, the buffer member generates a repulsive force in a direction opposite to a direction of the pressing force so that the floating plate is floatable; and a press member connected with the connector soft-contact member such that they are openable and closable relative to each other, the press member comprising: a second base plate; and a connector bearing piece which is mounted to the second base plate and which is positioned just opposite to the floating plate when the connector soft-contact member and the press member are closed.

According to embodiments of the present invention, the first base plate is formed with a groove within which the floating plate is disposed, position limit protrusions, configured to limit the floating plate within the groove, are disposed on tops of groove walls of the groove; the buffer member comprises at least one pair of first magnets, and one of each pair of first magnets is mounted to the floating plate, while the other is mounted to a groove bottom of the groove, such that each pair of first magnets are positioned opposite to each other, and magnetic poles, having the same polarity, of each pair of first magnets face towards each other.

According to embodiments of the present invention, the buffer member comprises two pairs of first magnets symmetrically disposed at two ends of the floating plate, or the buffer member comprises four pairs of first magnets respectively disposed at four corners of the floating plate.

According to embodiments of the present invention, the buffer member comprises at least one spring, and each spring has one end mounted to the floating plate, and the other end mounted to the first base plate.

According to embodiments of the present invention, the first base plate is a carrier platform to which one side of the second base plate is hinged, or the press tool further comprises a carrier platform to which the first base plate is mounted and to which one side of the second base plate is hinged.

According to embodiments of the present invention, the connector soft-contact member further comprises at least one second magnet mounted to the first base plate, the second base plate of the press member is formed with at least one magnet through hole matching the at least one second magnet, such that the at least one second magnet passes through at least one magnet through hole in a one-to-one correspondence when the connector soft-contact member and the press member are closed, the press member further comprises: a switch plate rotatably mounted to the second base plate, the switch plate and the connector bearing piece being mounted to two opposite surfaces of the second base plate, respectively; and at least one third magnet and at least one fourth magnet which are mounted to the switch plate, such that a magnetic pole of the third magnet facing towards the connector soft-contact member has an opposite polarity to that of a magnetic pole of the second magnet facing towards the press member and is exposed through the magnet through hole when the switch plate is rotated to a first position, and a magnetic pole of the fourth magnet facing towards the connector soft-contact member has the same polarity as the magnetic pole of the second magnet facing towards the press member and is exposed through the magnet through hole when the switch plate is rotated to a second position.

According to embodiments of the present invention, the at least one second magnet comprises two second magnets symmetrically located on two sides of the floating plate.

According to embodiments of the present invention, the press member further comprises at least one fifth magnet mounted to the second base plate, and the at least one fifth magnet attracts the at least one third magnet in a one-to-one correspondence when the switch plate is rotated to the second position.

According to embodiments of the present invention, the second base plate is a carrier platform to which one side of the first base plate is hinged, or the press tool further comprises a carrier platform to which the second base plate is mounted and to which one side of the first base plate is hinged.

According to embodiments of the present invention, the press member further comprises at least one second magnet mounted to the second base plate, the first base plate of the connector soft-contact member is formed with at least one magnet through hole matching the at least one second magnet, such that the at least one second magnet passes through the at least one magnet through hole in a one-to-one correspondence when the connector soft-contact member and the press member are closed; and the connector soft-contact member further comprises: a switch plate rotatably mounted to the first base plate, the switch plate and the floating plate being mounted to two opposite surfaces of the first base plate, respectively; and at least one third magnet and at least one fourth magnet which are mounted to the switch plate, such that a magnetic pole of the third magnet facing towards the press member has an opposite polarity to that of a magnetic pole of the second magnet facing towards the connector soft-contact member and is exposed through the magnet through hole when the switch plate is rotated to a first position, and a magnetic pole of the fourth magnet facing towards the press member has the same polarity as the magnetic pole of the second magnet facing towards the connector soft-contact member and is exposed through the magnet through hole when the switch plate is rotated to a second position.

According to embodiments of the present invention, the at least one second magnet comprises two second magnets symmetrically located on two sides of the connector bearing piece.

According to embodiments of the present invention, the connector soft-contact member further comprises at least one fifth magnet mounted to the first base plate, and the at least one fifth magnet attracts the at least one third magnet in a one-to-one correspondence when the switch plate is rotated to the second position.

According to embodiments of the present invention, an adjusting knob is fixedly mounted to the switch plate and is configured to drive the switch plate to rotate.

According to embodiments of the present invention, position limit pins are disposed on two sides of the switch plate, respectively, and are located on a rotation path of the switch plate so that the switch plate is limited between the first position and the second position.

According to embodiments of the present invention, the connector soft-contact member further comprises at least one alignment pin mounted to the first base plate, and the second base plate of the press member is formed with at least one pin alignment hole matching the at least one alignment pin, such that the at least one alignment pin passes through the at least one pin alignment hole in a one-to-one correspondence when the connector soft-contact member and the press member are closed.

According to embodiments of the present invention, the at least one alignment pin comprises two alignment pins symmetrically located on two sides of the floating plate.

According to embodiments of the present invention, the press member further comprises at least one alignment pin mounted to the second base plate, and the first base plate of the connector soft-contact member is formed with at least one pin alignment hole matching the at least one alignment pin, such that the at least one alignment pin passes through the at least one pin alignment hole in a one-to-one correspondence when the connector soft-contact member and the press member are closed.

According to embodiments of the present invention, the at least one alignment pin comprises two alignment pins symmetrically located on two sides of the connector bearing piece.

According to embodiments of the present invention, an apparatus connector is mounted to the connector bearing piece.

Embodiments of the present invention further provide an electronic product detecting apparatus comprising the press tool.

BRIEF DESCRIPTION OF THE DRAWINGS

In order to describe embodiments of the present invention or technical solutions in the prior art more clearly, accompanying drawings required for describing the embodiments or the prior art will be simply explained as below. Apparently, the accompanying drawings for the following description are only some embodiments of the present invention. Those skilled in the art also could derive other accompanying drawings from these accompanying drawings without making a creative work.

DETAILED DESCRIPTION OF THE EMBODIMENTS

In order that the above and other objects, advantages, and features of embodiments of the present invention become more apparent and are more readily appreciated, a clear and complete description of the technical solutions in the embodiments will be made as below with reference to examples of the present invention taken in conjunction with the accompanying drawings. Apparently, the described embodiments are some of the embodiments of the present invention rather than all of the embodiments of the present invention. It will be understood by those skilled in the art that modifications to the following embodiments may be made. All of the modifications made without departing from the principles and spirit of the present invention should fall within the protection scope of the present invention.

Figure 1:
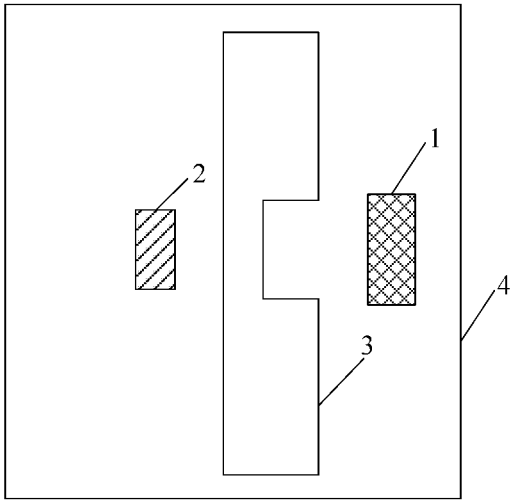
FIG. 1 and FIG. 2 are schematic diagrams showing a conventional connectional structure of a product connector and an apparatus connector.
Figure 2:
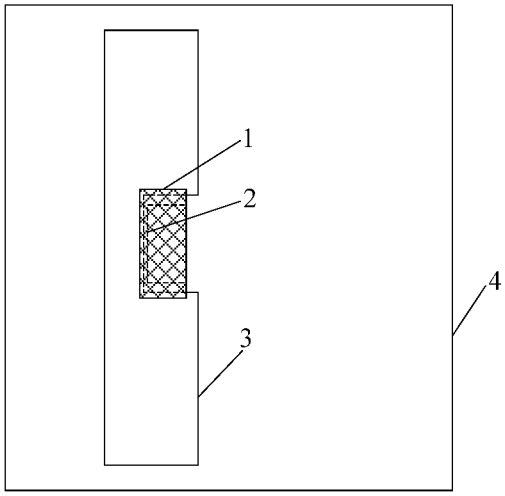
Figure 3:
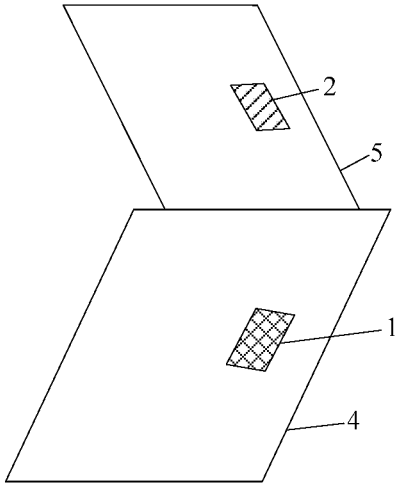
FIG. 3 is a schematic diagram showing another conventional connectional structure of the product connector and the apparatus connector.
Figure 4:
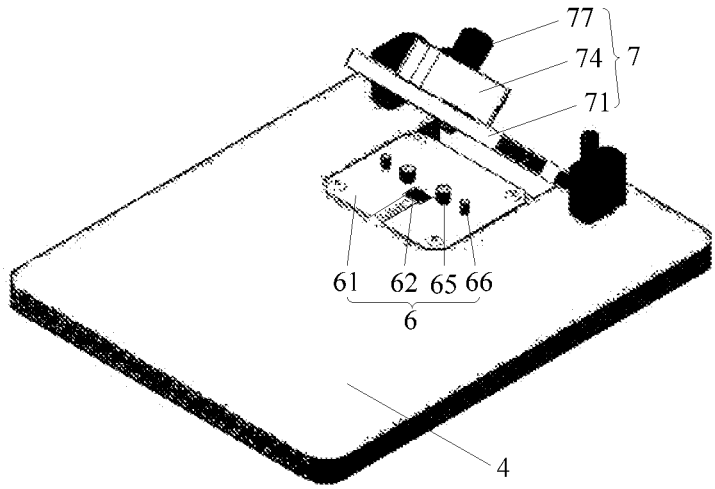
FIG. 4 is a schematic perspective view showing a structure of a press tool according to an embodiment of the present invention.
Figure 5:
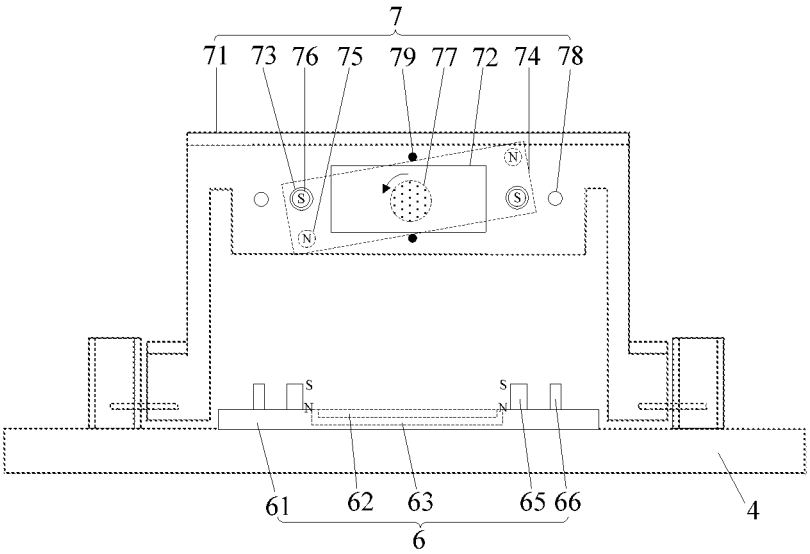
FIG. 5 is a schematic front view showing the structure of the press tool according to the embodiment of the present invention.

Embodiments of the present invention provide a press tool. As shown in FIG. 4 and FIG. 5, the press tool comprises: a connector soft-contact member 6, and a press member 7 which is pivotable relative to the connector soft-contact member 6 so that the press member 7 is connected with the connector soft-contact member 6 such that they are openable and closable relative to each other.

As shown in FIG. 4 to FIG. 8, the connector soft-contact member 6 comprises: a first base plate 61; a floating plate 62 mounted to the first base plate 61; and a buffer member 64 mounted between the first base plate 61 and the floating plate 62. The buffer member 64 is configured such that when the buffer member receives a pressing force 64, it generates a repulsive force in a direction opposite to a direction of the pressing force, so that the floating plate 62 is floatable in an up-down direction. Specifically, when the floating plate 62 receives a downward pressing force, it floats downwards. In this case, the buffer member 64 also receives a pressing force, so that the buffer member 64 generates an upward repulsive force. The floating plate 62 is in turn floated upwards by the upward repulsive force. With the upward floating of the floating plate 62, the upward repulsive force is gradually decreased. Finally, forces including the downward pressing force, the upward repulsive force and a gravity of the floating plate 62 itself and received by the floating plate 62 are balanced.

As shown in FIG. 4 to FIG. 5 and FIG. 10 to FIG. 11, the press member 7 comprises: a second base plate 71 and a connector bearing piece 72. The connector bearing piece 72 is mounted to an inner side of the second base plate 71 (i.e. a side of the second base plate 71 facing towards the connector soft-contact member 6 when the connector soft-contact member 6 and the press member 7 are closed) and an apparatus connector is mounted to the connector bearing piece 72. The connector bearing piece 72 is positioned just opposite to the floating plate 62 when the connector soft-contact member 6 and the press member 7 are closed.

When a product is detected with the press tool, a product connector of the product is placed between the floating plate 62 of the connector soft-contact member 6 and the connector bearing piece 72 of the press member 7, and the connector soft-contact member 6 and the press member 7 are closed so that the connector bearing piece 72 is positioned just opposite to the floating plate 62. Since the apparatus connector is mounted to the connector bearing piece 72, the product connector is positioned just opposite to and comes into contact with the apparatus connector.

When the product connector comes into contact with the apparatus connector, the connector bearing piece 72 pushes the floating plate 62 to apply a pressing force to the floating plate 62. Meanwhile, the buffer member 64 disposed under the floating plate 62 generates a repulsive force in a direction opposite to a direction of the pressing force. The product connector and the apparatus connector are stably coupled under the action of the repulsive force, thereby ensuring favorable performing of the detection. In addition, a buffer space is provided for the product connector and the apparatus connector due to existence of the buffer member 64, so that they will not be brought into a plug-in connection, thereby avoiding damage to the connectors by plugging and unplugging, and thus saving cost.

In the press tool, the buffer member 64 of the connector soft-contact member 6 may be achieved in various manners.

Figure 7:
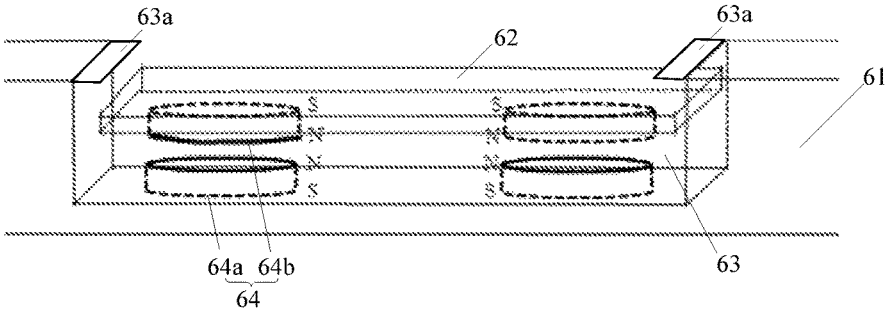
FIG. 7 is a schematic perspective view showing the structure of the connector soft-contact member when cut along a line AA in FIG. 6.
Figure 8:
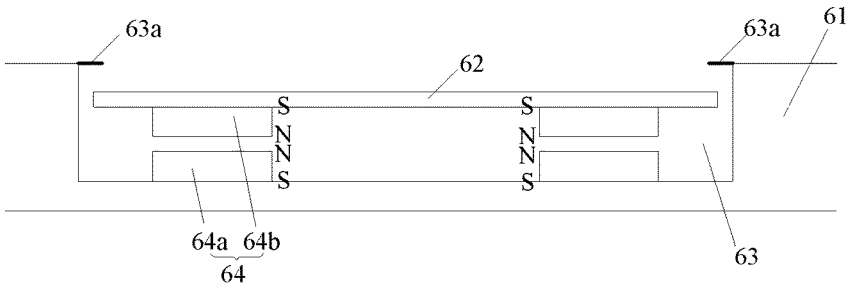
FIG. 8 is a schematic view showing the structure of the connector soft-contact member taken along the line AA in FIG. 6.

For example, as shown in FIG. 7 and FIG. 8, the first base plate 61 is formed with a groove 63 within which the floating plate 62 is disposed, and position limit protrusions 63*a* are disposed on tops of groove walls of the groove 63. The position limit protrusions 63*a* are configured to limit the floating plate 62 within the groove 63, thereby preventing the floating plate 62 from falling off. Specifically, the position limit protrusions 63*a* may be horizontal sheet-shaped structures along inner edges of an opening of the groove 63. A distance between the position limit protrusions 63*a* positioned opposite to each other is slightly less than a size of the floating plate 62 along a corresponding direction. The buffer member 64 comprises at least one pair of first magnets 64*a* and 64*b*. One of each pair of first magnets 64*a* and 64*b* is mounted to the floating plate 62, while the other is mounted to a groove bottom of the groove 63. For example, as shown in FIG. 7 and FIG. 8, the first magnet 64*a* is mounted to the groove bottom of the groove 63, while the first magnet 64*b* is mounted to the floating plate 62. Each pair of first magnets 64*a* and 64*b* are positioned opposite to each other, and magnetic poles, having the same polarity, of each pair of first magnets 64*a* and 64*b* face towards each other. As shown in FIG. 7 and FIG. 8, N poles of the first magnets 64*a* and 64*b* face towards each other. With such a structure, when the floating plate 62 receives a pressing force, the first magnets 64*a* and 64*b* generate repulsive forces, so that the floating plate 62 floats in an up-down direction within the groove 63.

The buffer member 64 comprises at least one pair of first magnets 64*a* and 64*b*. For example, the buffer member 64 may comprise two pairs of first magnets 64*a* and 64*b* symmetrically disposed at two ends of the floating plate 62, or the buffer member 64 may comprise four pairs of first magnets 64*a* and 64*b* respectively disposed at four corners of the floating plate 62. In this way, it is ensured that a space occupied by the buffer member 64 is not too large, and the floating plate 62 can receive symmetrically distributed forces, so that the floating plate 62 is always retained to be horizontal during floating in the up-down direction. As a result, the product connector and the apparatus connector are brought into a better contact with each other.

Figure 9:
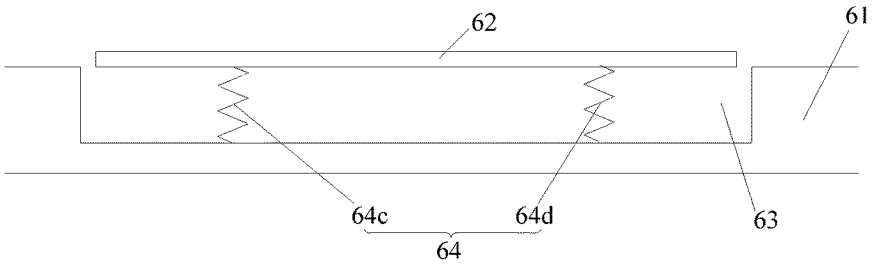
FIG. 9 is another schematic view showing the structure of the connector soft-contact member taken along the line AA in FIG. 6.
Figure 10:
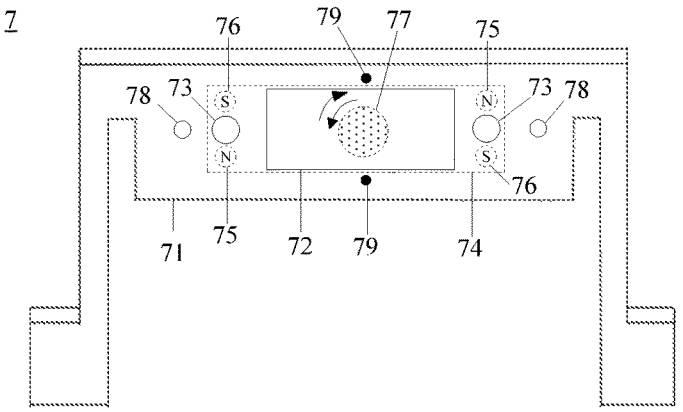
FIG. 10 is a schematic front view showing a structure of a press member of the press tool according to the embodiment of the present invention.
Figure 11:
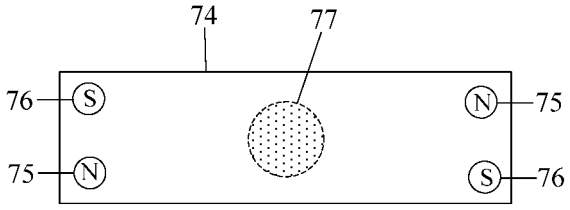
FIG. 11 is a schematic view showing a structure of a switch plate of the press member shown in FIG. 10.

For example, as shown in FIG. 9, the buffer member 64 comprises at least one spring (for example a spring 64*c* or 64*d*), and each spring has one end mounted to the floating plate 62, and the other end mounted to the first base plate 61. With such a structure, when the floating plate 62 receives a pressing force, the spring itself is deformed to generate a repulsive force in a direction opposite to a direction of the pressing force, so that the floating plate 62 floats in an up-down direction within the groove 63.

The buffer member 64 comprises at least one spring. For example, the buffer member 64 may comprise two springs symmetrically disposed at two ends of the floating plate 62, or the buffer member 64 may comprise four springs respectively disposed at four corners of the floating plate 62. In this way, it is ensured that a space occupied by the buffer member 64 is not too large, and the floating plate 62 can receive symmetrically distributed forces, so that the floating plate 62 is always retained to be horizontal during floating in the up-down direction. As a result, the product connector and the apparatus connector are brought into a better contact with each other. Furthermore, referring to FIG. 9, the first base plate 61 may be formed with a groove 63. The spring is disposed within the groove 63, thereby saving a space occupied by the spring. In addition, a position of the floating plate 62 in a horizontal direction is constrained by the groove to prevent the floating plate 62 from moving horizontally during floating.

In a first operational mode according to an example of the present invention, the connector soft-contact member of the press tool is in a horizontal plane and is fixed in position and the press member is located above the connector soft-contact member when a product is detected with the press tool according to the present embodiment. During detection, a product connector of the product to be detected is placed on the floating plate of the connector soft-contact member, and the press member is closed to the connector soft-contact member, so that the apparatus connector mounted to the connector bearing piece of the press member is brought into contact with the product connector located under the apparatus connector and placed on the floating plate of the connector soft-contact member. Therefore, during detection, the product connector is located under the apparatus connector.

In a second operational mode according to an example of the present invention, the press member of the press tool is in a horizontal plane and is fixed in position and the connector soft-contact member is located above the press member when a product is detected with the press tool according to the present embodiment. During detection, a product connector of the product to be detected is first suspended between the connector bearing piece of the press member and the floating plate of the connector soft-contact member, and then the connector soft-contact member is closed to the press member, so that the product connector is fixed between the connector bearing piece and the floating plate and thus is brought into contact with the apparatus connector mounted to the connector bearing piece. Therefore, during detection, the product connector is located over the apparatus connector.

A structure of the press tool for operating in the first operational mode according to the example of the present invention may be specifically as follows. Referring to FIG. 4 and FIG. 5, the press tool further comprises a carrier platform 4 to which the first base plate 61 of the connector soft-contact member 6 of the press tool is mounted, so that the connector soft-contact member 6 is in a horizontal plane and is fixed in position. The first base plate 61 may be fixedly mounted to the carrier platform 4 by means of a mounting hole 68 shown in FIG. 6 and corresponding mounting elements (for example a threaded hole and a screw). Of course, the carrier platform 4 may also serve directly as the first base plate 61 of the connector soft-contact member 6. A side of the second base plate 71 of the press member 7 of the press tool is hinged to the carrier platform 4 so that the press member 7 is located above the connector soft-contact member 6. Further, the second base plate 71 is rotatable around a hinge pivot so that the press member 7 is closed to the connector soft-contact member 6 or is opened from the connector soft-contact member 6.

Referring to FIG. 4 to FIG. 6 and FIG. 10 to FIG. 11, the connector soft-contact member 6 of the press tool having the above structure for operating in the first operational mode may further comprise at least one second magnet 65 mounted to the first base plate 61, and the second base plate 71 of the press member 7 is also formed with at least one magnet through hole 73, so that the at least one magnet through hole 73 and the at least one second magnet 65 are in a one-to-one correspondence with each other in position and match each other. The at least one second magnet 65 passes through the corresponding magnet through hole 73 when the connector soft-contact member 6 and the press member 7 are closed.

Further, the press member 7 further comprises: a switch plate 74, at least one third magnet 75 and at least one fourth magnet 76.

The switch plate 74 is mounted to the second base plate 71, and the switch plate 74 and the connector bearing piece 72 are mounted to two opposite surfaces of the second base plate 71, respectively. Since the connector bearing piece 72 is mounted to the inner side of the second base plate 71 (i.e. the side of the second base plate 71 facing towards the connector soft-contact member 6 when the connector soft-contact member 6 and the press member 7 are closed), the switch plate 74 is mounted to an outer side of the second base plate 71 (i.e. the other side of the second base plate 71 facing away from the connector soft-contact member 6 when the connector soft-contact member 6 and the press member 7 are closed). The switch plate 74 is rotatable relative to the second base plate 71.

The third magnet 75 and the fourth magnet 76 are mounted to the switch plate 74. The third magnet 75 and the fourth magnet 76 may be embedded in the switch plate 74 and at least one magnetic pole of each of the third magnet 75 and the fourth magnet 76 is exposed from a surface of the switch plate 74 facing towards the second base plate 71. Alternatively, the third magnet 75 and the fourth magnet 76 may be mounted directly on the surface of the switch plate 74 facing towards the second base plate 71.

Figure 12:
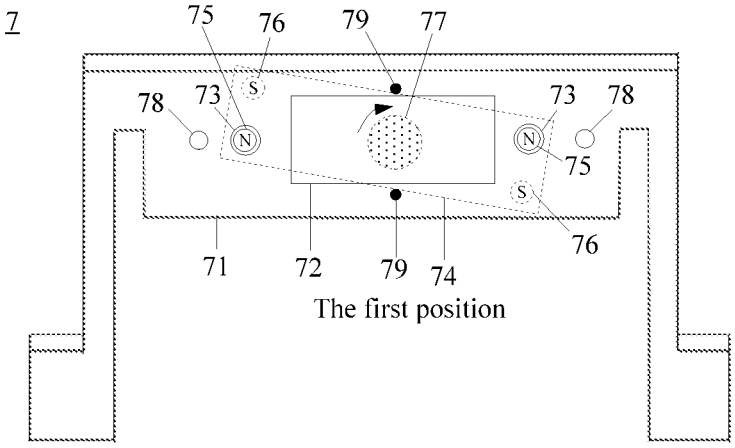
FIG. 12 is a schematic view showing the structure of the switch plate of the press member shown in FIG. 10, when the switch plate is in a first position.
Figure 13:
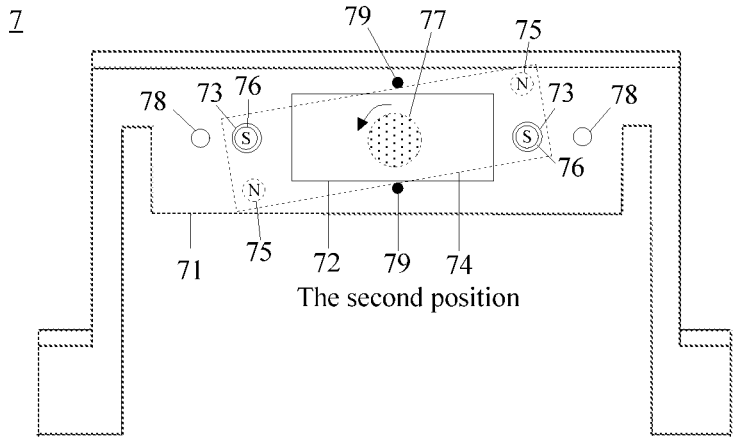
FIG. 13 is a schematic view showing the structure of the switch plate of the press member shown in FIG. 10, when the switch plate is in a second position.

Specifically, as shown in FIG. 12, a magnetic pole of the third magnet 75 facing towards the connector soft-contact member 6 has an opposite polarity to that of a magnetic pole of the second magnet 65 facing towards the press member 7, and is exposed through the magnet through hole 73 of the second base plate 71 when the switch plate 74 is rotated to a first position. As shown in FIG. 13, a magnetic pole of the fourth magnet 76 facing towards the connector soft-contact member 6 has the same polarity as a magnetic pole of the second magnet 65 facing towards the press member 7, and is exposed through the magnet through hole 73 of the second base plate 71 when the switch plate 74 is rotated to a second position.

Referring to FIG. 5, it is assumed that the magnetic pole of the second magnet 65 facing towards the press member 7 is an S pole, the magnetic pole of the third magnet 75 facing towards the connector soft-contact member 6 is an N pole, and the magnetic pole of the fourth magnet 76 facing towards the connector soft-contact member 6 is an S pole.

When the press member 7 needs to be closed to the connector soft-contact member 6, the switch plate 74 of the press member 7 is rotated to the first position, the N pole of the third magnet 75 mounted to the switch plate 74 is exposed through the magnet through hole 73 of the second base plate 71 of the press member 7, as shown in FIG. 12. Meanwhile, the second magnet 65 of the connector soft-contact member 6 passes through the magnet through hole 73 of the second base plate 71 of the press member 7, so that the S pole of the second magnet 65 and the N pole of the third magnet 75 attract each other. As a result, the press member 7 is more tightly closed to the connector soft-contact member 6.

When the press member 7 needs to be opened from the connector soft-contact member 6, the switch plate 74 of the press member 7 is rotated to the second position, the S pole of the fourth magnet 76 mounted to the switch plate 74 is exposed through the magnet through hole 73 of the second base plate 71 of the press member 7, as shown in FIG. 13.

Meanwhile, the second magnet 65 of the connector soft-contact member 6 passes through the magnet through hole 73 of the second base plate 71 of the press member 7, so that the S pole of the second magnet 65 and the S pole of the fourth magnet 76 repulse each other. As a result, the press member 7 is opened from the connector soft-contact member 6 quickly.

In addition, according to an example of the present, the at least one second magnet 65 may comprise two second magnets 65 symmetrically located on two sides of the floating plate 62. Accordingly, the at least one magnet through hole 72 comprises two magnet through holes 72, the at least one third magnet 75 comprises two third magnets 75, and the at least one fourth magnet 76 comprises two fourth magnets 76. As a result, a tightness of the connector soft-contact member 6 and the press member 7 when they are closed is ensured and the connector soft-contact member 6 and the press member 7 can be opened more quickly.

A fifth magnet may be disposed at the second base plate 71 of the press member 7 in order to avoid failure of opening one of the connector soft-contact member 6 and the press member 7 from the other due to an excessively large attractive force between the second magnet 65 and the third magnet 75 in a process of switching of the connector soft-contact member 6 and the press member 7 from a closed state to an open state. A magnetic pole of the fifth magnet is exposed from a surface of the second base plate 71 facing towards the switch plate 74, and has an opposite polarity to that of the magnetic pole of the third magnet 75 facing towards the connector soft-contact member 6. For example, if the magnetic pole of the third magnet 75 facing towards the connector soft-contact member 6 is an N pole, the magnetic pole of the fifth magnet exposed from the surface of the second base plate 71 facing towards the switch plate 74 is an S pole. In addition, when the switch plate 74 is rotated to the second position, the fifth magnet and the third magnet 75 are in a one-to-one correspondence with each other in position. Therefore, in the process of switching of the connector soft-contact member 6 and the press member 7 from the closed state to the open state, i.e. in a process of rotation of the switch plate 74 from the first position to the second position, the fifth magnet and the third magnet 75 attract each other in a one-to-one correspondence while the second magnet 65 and the fourth magnet 76 repulse each other in a one-to-one correspondence. Thereby, the connector soft-contact member 6 and the press member 7 are opened favorably.

As shown in FIG. 4 to FIG. 5 and FIG. 10 to FIG. 13, in order to facilitate rotation of the switch plate 74, an adjusting knob 77 may be fixedly mounted to the switch plate 74 for driving the switch plate 74 to rotate.

A alignment structure may be disposed in the press tool in order that the connector soft-contact member 6 and the press member 7 are aligned with each other more accurately when they are closed, thereby ensuring a better contact between the product connector and the apparatus connector. Specifically, as shown in FIG. 4 to FIG. 6 and FIG. 10 to FIG. 12, at least one alignment pin 66 is mounted to the first base plate 61 of the connector soft-contact member 6, and accordingly, the second base plate 71 of the press member 7 is formed with at least one pin alignment hole 78. The at least one alignment pin 66 matches the at least one pin alignment hole 78 in a one-to-one correspondence. The at least one alignment pin 66 passes through the corresponding pin alignment hole 78 when the connector soft-contact member 6 and the press member 7 are closed. Thereby, the connector soft-contact member 6 and the press member 7 are aligned with each other. For example, the at least one alignment pin 66 comprises two alignment pins 66 symmetrically located on two sides of the floating plate 62, and accordingly, the at least one pin alignment hole 78 comprises two pin alignment holes 78.

Of course, positions of the alignment pin 66 and the pin alignment hole 78 may also be exchanged as long as the connector soft-contact member 6 and the press member 7 can be aligned with each other accurately. In this case, at least one alignment pin is mounted to the second base plate 71 of the press member 7, and the first base plate 61 of the connector soft-contact member 6 is formed with at least one pin alignment hole matching the at least one alignment pin, such that the at least one alignment pin passes through the at least one pin alignment hole in a one-to-one correspondence when the connector soft-contact member 6 and the press member 7 are closed. For example, the at least one alignment pin 66 comprises two alignment pins 66 symmetrically located on two sides of the connector bearing piece 72, and accordingly, the at least one pin alignment hole 78 comprises two pin alignment holes 78.

In addition, as shown in FIG. 5, FIG. 10, FIG. 12, and FIG. 13, position limit pins 79 may also be disposed on two sides of the switch plate 74, respectively, and are located on a rotation path of the switch plate 74 to limit a rotation range of the switch plate 74, so that the switch plate 74 can be rotated only between the first position and the second position. Thereby, an excessive rotation of the switch plate 74 is avoided. Specifically, the number of the position limit pins 79 may be two. The two position limit pins 79 are located at middle positions on an upper side and a lower side of the switch plate 74, respectively. As shown in FIG. 12, when the switch plate 74 is rotated clockwise to the first position, an upper edge of the switch plate 74 is blocked by the position limit pin 79 located on the upper side of the switch plate 74, so that the switch plate 74 is stopped in the first position. As shown in FIG. 13, when the switch plate 74 is rotated anticlockwise to the second position, a lower edge of the switch plate 74 is blocked by the position limit pin 79 located on the lower side of the switch plate 74, so that the switch plate 74 is stopped in the second position.

Figure 6:
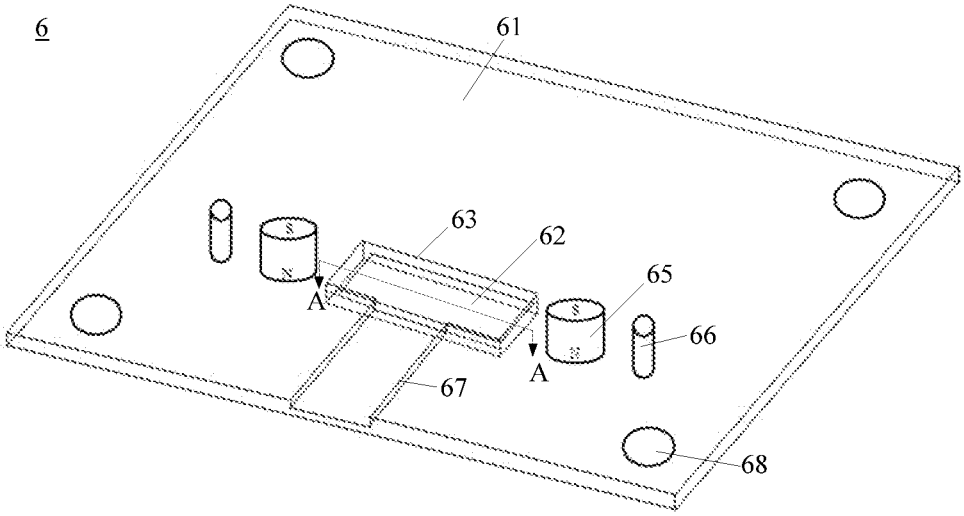
FIG. 6 is a schematic perspective view showing a structure of a connector soft-contact member of the press tool according to the embodiment of the present invention.

When a product is detected in the first operational mode, a product connector of the product needs to be placed on the floating plate 62 of the connector soft-contact member 6. As shown in FIG. 6, in order to limit a position of the product connector to ensure an effective contact between the product connector and the apparatus connector, a circuit board positioning groove 67 may be formed on the first base plate 61 of the connector soft-contact member 6. The circuit board positioning groove 67 is in communication with the groove 63 and extends from the groove 63 to an edge of the first base plate 61. The product connector is connected to a body of the product through a circuit board such as a flexible printed circuit board (FPC). Therefore, when the product connector is placed on the floating plate 62, the circuit board is located in the circuit board positioning groove 67, thereby limiting a position of the product connector.

Figure 14:
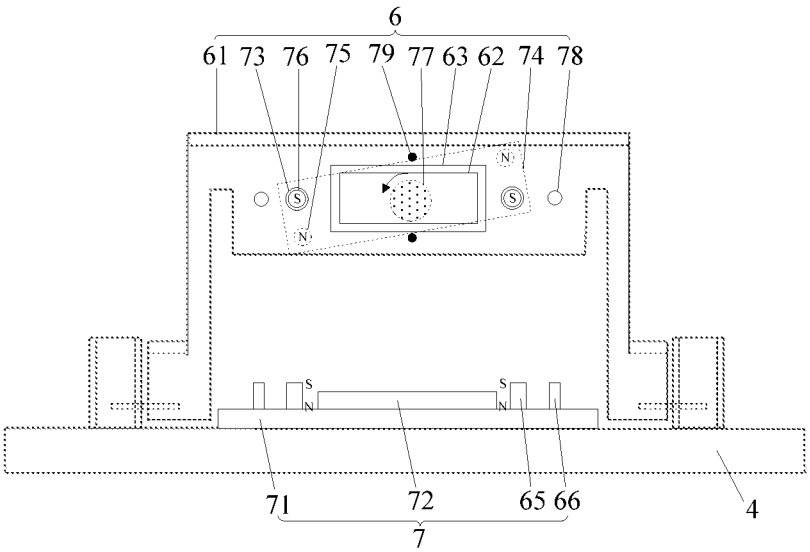
FIG. 14 is a schematic front view showing a structure of a press tool according to another embodiment of the present invention.

Referring to FIG. 14, the press tool for operating in the second operational mode according to the example of the present invention further comprises a carrier platform 4 to which the second base plate 71 of the press member 7 of the press tool is mounted, so that the press member 7 is in a horizontal plane and is fixed in position. Of course, the carrier platform 4 may also serve directly as the second base plate 71 of the press member 7. A side of the first base plate 61 of the connector soft-contact member 6 is hinged to the carrier platform 4 so that the connector soft-contact member 6 is located above the press member 7. Further, the first base plate 61 is rotatable around a hinge pivot so that the connector soft-contact member 6 is closed to the press member 7 or is opened from the press member 7.

Referring to FIG. 14, the press member 7 of the press tool having the above structure for operating in the second operational mode may further comprise at least one second magnet 65 mounted to the second base plate 71, and the first base plate 61 of the connector soft-contact member 6 is formed with at least one magnet through hole 73, so that the at least one magnet through hole 73 and the at least one second magnet 65 are in a one-to-one correspondence with each other in position and match each other. The at least one second magnet 65 passes through the corresponding magnet through hole 73 when the connector soft-contact member 6 and the press member 7 are closed.

Further, the connector soft-contact member 6 further comprises: a switch plate 74, at least one third magnet 75 and at least one fourth magnet 76.

The switch plate 74 is mounted to the first base plate 61, and the switch plate 74 and the floating plate 62 are mounted to two opposite surfaces of the first base plate 61, respectively. Since the floating plate 62 is mounted to the inner side of the first base plate 61 (i.e. the side of the first base plate 61 facing towards the press member 7 when the connector soft-contact member 6 and the press member 7 are closed), the switch plate 74 is mounted to an outer side of the first base plate 61 (i.e. the other side of the first base plate 61 facing away from the press member 7 when the connector soft-contact member 6 and the press member 7 are closed). The switch plate 74 is rotatable relative to the first base plate 61.

The third magnet 75 and the fourth magnet 76 are mounted to the switch plate 74. The third magnet 75 and the fourth magnet 76 may be embedded in the switch plate 74 and at least one magnetic pole of each of the third magnet 75 and the fourth magnet 76 is exposed from a surface of the switch plate 74 facing towards the first base plate 61. Alternatively, the third magnet 75 and the fourth magnet 76 may be mounted directly on the surface of the switch plate 74 facing towards the first base plate 61.

Specifically, as shown in FIG. 14, a magnetic pole of the third magnet 75 facing towards the press member 7 has an opposite polarity to that of a magnetic pole of the second magnet 65 facing towards the connector soft-contact member 6, and is exposed through the magnet through hole 73 of the first base plate 61 when the switch plate 74 is rotated to the first position. A magnetic pole of the fourth magnet 76 facing towards the press member 7 has the same polarity as a magnetic pole of the second magnet 65 facing towards the connector soft-contact member 6, and is exposed through the magnet through hole 73 of the first base plate 61 when the switch plate 74 is rotated to the second position.

Referring to FIG. 14, it is assumed that the magnetic pole of the second magnet 65 facing towards the connector soft-contact member 6 is an S pole, the magnetic pole of the third magnet 75 facing towards the press member 7 is an N pole, and the magnetic pole of the fourth magnet 76 facing towards the press member 7 is an S pole.

When the connector soft-contact member 6 needs to be closed to the press member 7, the switch plate 74 of the connector soft-contact member 6 is rotated to the first position, the N pole of the third magnet 75 mounted to the switch plate 74 is exposed through the magnet through hole 73 of the first base plate 61 of the connector soft-contact member 6. Meanwhile, the second magnet 65 of the press member 7 passes through the magnet through hole 73 of the first base plate 61 of the connector soft-contact member 6, so that the S pole of the second magnet 65 and the N pole of the third magnet 75 attract each other. As a result, the connector soft-contact member 6 is more tightly closed to the press member 7.

When the connector soft-contact member 6 needs to be opened from the press member 7, the switch plate 74 of the connector soft-contact member 6 is rotated to the second position, the S pole of the fourth magnet 76 mounted to the switch plate 74 is exposed through the magnet through hole 73 of the first base plate 61 of the connector soft-contact member 6. Meanwhile, the second magnet 65 of the press member 7 passes through the magnet through hole 73 of the first base plate 61 of the connector soft-contact member 6, so that the S pole of the second magnet 65 and the S pole of the fourth magnet 76 repulse each other. As a result, the connector soft-contact member 6 is opened from the press member 7 quickly.

In some embodiments, the at least one second magnet 65 may comprise two second magnets 65 symmetrically located on two sides of the connector bearing piece 72. Accordingly, the at least one magnet through hole 72 comprises two magnet through holes 72, the at least one third magnet 75 comprises two third magnets 75, and the at least one fourth magnet 76 comprises two fourth magnets 76. As a result, a tightness of the connector soft-contact member 6 and the press member 7 when they are closed is ensured and the connector soft-contact member 6 and the press member 7 can be opened more quickly.

A fifth magnet may be disposed at the first base plate 61 of the connector soft-contact member 6 in order to avoid failure of opening one of the connector soft-contact member 6 and the press member 7 from the other due to an excessively large attractive force between the second magnet 65 and the third magnet 75 in a process of switching of the connector soft-contact member 6 and the press member 7 from a closed state to an open state. A magnetic pole of the fifth magnet is exposed from a surface of the first base plate 61 facing towards the switch plate 74, and has an opposite polarity to that of the magnetic pole of the third magnet 75 facing towards the press member 7. For example, if the magnetic pole of the third magnet 75 facing towards the press member 7 is an N pole, the magnetic pole of the fifth magnet exposed from the surface of the first base plate 61 facing towards the switch plate 74 is an S pole. In addition, when the switch plate 74 is rotated to the second position, the fifth magnet and the third magnet 75 are in a one-to-one correspondence with each other in position. Therefore, in the process of switching of the connector soft-contact member 6 and the press member 7 from the closed state to the open state, i.e. in a process of rotation of the switch plate 74 from the first position to the second position, the fifth magnet and the third magnet 75 attract each other in a one-to-one correspondence while the second magnet 65 and the fourth magnet 76 repulse each other in a one-to-one correspondence. Thereby, the connector soft-contact member 6 and the press member 7 are opened favorably.

As shown in FIG. 14, in order to facilitate rotation of the switch plate 74, an adjusting knob 77 may be fixedly mounted to the switch plate 74 for driving the switch plate 74 to rotate.

A alignment structure may be disposed in the press tool in order that the connector soft-contact member 6 and the press member 7 are aligned with each other more accurately when they are closed, thereby ensuring a better contact between the product connector and the apparatus connector. Specifically, as shown in FIG. 14, at least one alignment pin 66 is mounted to the second base plate 71 of the press member 7, and accordingly, the first base plate 61 of the connector soft-contact member 6 is formed with at least one pin alignment hole 78. The at least one alignment pin 66 matches the at least one pin alignment hole 78 in a one-to-one correspondence. The at least one alignment pin 66 passes through the corresponding pin alignment hole 78 when the connector soft-contact member 6 and the press member 7 are closed. Thereby, the connector soft-contact member 6 and the press member 7 are aligned with each other. For example, the at least one alignment pin 66 comprises two alignment pins 66 symmetrically located on two sides of the connector bearing piece 72, and accordingly, the at least one pin alignment hole 78 comprises two pin alignment holes 78.

Of course, positions of the alignment pin 66 and the pin alignment hole 78 may also be exchanged as long as the connector soft-contact member 6 and the press member 7 can be aligned with each other accurately. In this case, at least one alignment pin is mounted to the first base plate 61 of the connector soft-contact member 6, and the second base plate 71 of the press member 7 is formed with at least one pin alignment hole matching the at least one alignment pin, such that the at least one alignment pin passes through the at least one pin alignment hole in a one-to-one correspondence when the connector soft-contact member 6 and the press member 7 are closed. For example, the at least one alignment pin 66 comprises two alignment pins 66 symmetrically located on two sides of the floating plate 62, and accordingly, the at least one pin alignment hole 78 comprises two pin alignment holes 78.

In addition, as shown in FIG. 14, position limit pins 79 may also be disposed on two sides of the switch plate 74, respectively, and are located on a rotation path of the switch plate 74 to limit a rotation range of the switch plate 74, so that the switch plate 74 can be rotated only between the first position and the second position. Thereby, an excessive rotation of the switch plate 74 is avoided. The specific arrangement of the position limit pins 79 of the press tool for operating in the first operational mode may be referred to for a specific arrangement of the position limit pins 79 of the press tool for operating in the second operational mode, and the specific arrangement of the position limit pins 79 of the press tool for operating in the second operational mode is no longer described herein for the sake of brevity.

Embodiments of the present invention further provide an electronic product detecting apparatus comprising the above press tool. When a product is detected by the electronic product detecting apparatus according to the present embodiment, the product connector and the apparatus connector are brought into soft-contact with each other with the help of the press tool of the electronic product detecting apparatus. In other words, the product connector and the apparatus connector can be stably coupled, while a buffer space is provided for the product connector and the apparatus connector. In this way, favorable performing of the detection can be ensured while the product connector and the apparatus connector will not be brought into a plug-in connection, thereby avoiding damage to the connectors by plugging and unplugging.

When a product is detected with the press tool according to the embodiments of the present invention, the product connector is placed between the floating plate of the connector soft-contact member and the connector bearing piece of the press member, and the connector soft-contact member and the press member are closed so that the product connector and the apparatus connector mounted to the connector bearing piece are brought into contact with each other. When the product connector comes into contact with the apparatus connector, a pressing force is applied to the floating plate. Meanwhile, when the buffer member receives a pressing force, it generates a repulsive force in a direction opposite to a direction of the pressing force since the buffer member is disposed under the floating plate. Therefore, the floating plate floats in an up-down direction under the action of the pressing force and the repulsive force. As a result, the product connector and the apparatus connector are stably coupled, thereby ensuring favorable performing of the detection. In addition, a buffer space is provided for the product connector and the apparatus connector, so that they will not be brought into a plug-in connection, thereby avoiding damage to the connectors by plugging and unplugging.

The above embodiments are only used to explain the present invention, and should not be construed to limit the present invention. It will be appreciated by those skilled in the art that various changes and modifications may be made therein without departing from the spirit of the present invention, the scope of which is defined in the appended claims and their equivalents.

What is claimed is:

1. A press tool comprising:

a connector soft-contact member comprising: a first base plate; a floating plate mounted to the first base plate; and a buffer member mounted between the first base plate and the floating plate and configured such that, when receiving a pressing force, the buffer member generates a repulsive force in a direction opposite to a direction of the pressing force so that the floating plate is floatable; and a press member connected with the connector soft-contact member such that they are openable and closable relative to each other, the press member comprising: a second base plate; and a connector bearing piece which is mounted to the second base plate and which is positioned just opposite to the floating plate when the connector soft-contact member and the press member are closed.

2. The press tool of claim 1, wherein:

the first base plate is formed with a groove within which the floating plate is disposed;

position limit protrusions, configured to limit the floating plate within the groove, are disposed on tops of groove walls of the groove; and the buffer member comprises at least one pair of first magnets, and one of each pair of first magnets is mounted to the floating plate, while the other is mounted to a groove bottom of the groove, such that each pair of first magnets are positioned opposite to each other, and magnetic poles, having the same polarity, of each pair of first magnets face towards each other.

3. The press tool of claim 2, wherein:

the buffer member comprises two pairs of first magnets symmetrically disposed at two ends of the floating plate; or the buffer member comprises four pairs of first magnets respectively disposed at four corners of the floating plate.

4. The press tool of claim 1, wherein:

the buffer member comprises at least one spring, and each spring has a first end mounted to the floating plate, and a second end mounted to the first base plate.

5. The press tool of claim 1, wherein:

the first base plate is a carrier platform to which one side of the second base plate is hinged; or the press tool further comprises a carrier platform to which the first base plate is mounted and to which one side of the second base plate is hinged.

6. The press tool of claim 5, wherein:

the connector soft-contact member further comprises at least one second magnet mounted to the first base plate;

the second base plate of the press member is formed with at least one magnet through hole matching the at least one second magnet, such that the at least one second magnet passes through at least one magnet through hole in a one-to-one correspondence when the connector soft-contact member and the press member are closed; and the press member further comprises: a switch plate rotatably mounted to the second base plate, the switch plate and the connector bearing piece being mounted to two opposite surfaces of the second base plate, respectively; and at least one third magnet and at least one fourth magnet which are mounted to the switch plate, such that a magnetic pole of the third magnet facing towards the connector soft-contact member has an opposite polarity to that of a magnetic pole of the second magnet facing towards the press member and is exposed through the magnet through hole when the switch plate is rotated to a first position, and a magnetic pole of the fourth magnet facing towards the connector soft-contact member has the same polarity as the magnetic pole of the second magnet facing towards the press member and is exposed through the magnet through hole when the switch plate is rotated to a second position.

7. The press tool of claim 6, wherein:

the at least one second magnet comprises two second magnets symmetrically located on two sides of the floating plate.

8. The press tool of claim 6, wherein:

the press member further comprises at least one fifth magnet mounted to the second base plate, and the at least one fifth magnet attracts the at least one third magnet in a one-to-one correspondence when the switch plate is rotated to the second position.

9. The press tool of claim 1, wherein:

the second base plate is a carrier platform to which one side of the first base plate is hinged; or the press tool further comprises a carrier platform to which the second base plate is mounted and to which one side of the first base plate is hinged.

10. The press tool of claim 9, wherein:

the press member further comprises at least one second magnet mounted to the second base plate;

the first base plate of the connector soft-contact member is formed with at least one magnet through hole matching the at least one second magnet, such that the at least one second magnet passes through the at least one magnet through hole in a one-to-one correspondence when the connector soft-contact member and the press member are closed; and the connector soft-contact member further comprises: a switch plate rotatably mounted to the first base plate, the switch plate and the floating plate being mounted to two opposite surfaces of the first base plate, respectively; and at least one third magnet and at least one fourth magnet which are mounted to the switch plate, such that a magnetic pole of the third magnet facing towards the press member has an opposite polarity to that of a magnetic pole of the second magnet facing towards the connector soft-contact member and is exposed through the magnet through hole when the switch plate is rotated to a first position, and a magnetic pole of the fourth magnet facing towards the press member has the same polarity as the magnetic pole of the second magnet facing towards the connector soft-contact member and is exposed through the magnet through hole when the switch plate is rotated to a second position.

11. The press tool of claim 10, wherein:

the at least one second magnet comprises two second magnets symmetrically located on two sides of the connector bearing piece.

12. The press tool of claim 10, wherein:

the connector soft-contact member further comprises at least one fifth magnet mounted to the first base plate, and the at least one fifth magnet attracts the at least one third magnet in a one-to-one correspondence when the switch plate is rotated to the second position.

13. The press tool of claim 6, wherein:

an adjusting knob is fixedly mounted to the switch plate and configured to drive the switch plate to rotate.

14. The press tool of claim 6, wherein:

position limit pins are disposed on two sides of the switch plate, respectively, and are located on a rotation path of the switch plate so that the switch plate is limited between the first position and the second position.

15. The press tool of claim 1, wherein:

the connector soft-contact member further comprises at least one alignment pin mounted to the first base plate; and the second base plate of the press member is formed with at least one pin alignment hole matching the at least one alignment pin, such that the at least one alignment pin passes through the at least one pin alignment hole in a one-to-one correspondence when the connector soft-contact member and the press member are closed.

16. The press tool of claim 15, wherein:

the at least one alignment pin comprises two alignment pins symmetrically located on two sides of the floating plate.

17. The press tool of claim 1, wherein:

the press member further comprises at least one alignment pin mounted to the second base plate; and the first base plate of the connector soft-contact member is formed with at least one pin alignment hole matching the at least one alignment pin, such that the at least one alignment pin passes through the at least one pin alignment hole in a one-to-one correspondence when the connector soft-contact member and the press member are closed.

18. The press tool of claim 17, wherein:

the at least one alignment pin comprises two alignment pins symmetrically located on two sides of the connector bearing piece.

19. The press tool of claim 1, wherein:

an apparatus connector is mounted to the connector bearing piece.

20. An electronic product detecting apparatus comprising the press tool according to claim 1.

* * * * *